US008561828B2

(12) United States Patent
Krauss et al.

(10) Patent No.: US 8,561,828 B2
(45) Date of Patent: Oct. 22, 2013

(54) RECEPTACLE FOR PHARMACEUTICAL CONTAINERS

(75) Inventors: Ulrich Krauss, Ilshofen (DE); Steffen Humpfer, Satteldorf (DE); Klaus Ullherr, Crailsheim (DE); Werner Mayer, Crailsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/382,117

(22) PCT Filed: Mar. 12, 2010

(86) PCT No.: PCT/EP2010/056522

§ 371 (c)(1),
(2), (4) Date: Mar. 23, 2012

(87) PCT Pub. No.: WO2011/000623

PCT Pub. Date: Jan. 6, 2011

(65) Prior Publication Data

US 2012/0181285 A1 Jul. 19, 2012

(30) Foreign Application Priority Data

Jul. 3, 2009 (DE) ..... 10 2009 027 454

(51) Int. Cl.
*B65D 1/24* (2006.01)
*B65D 1/36* (2006.01)

(52) U.S. Cl.
USPC ..... 220/507; 206/564

(58) Field of Classification Search
USPC ..... 220/507, 676, 675, 669, 500, 660, 509, 220/514; 422/104; 206/569, 563, 562; 211/85.13

IPC ..... B65D 1/24,1/36
See application file for complete search history.

(56) References Cited

U.S. PATENT DOCUMENTS

| | | | | | |
|---|---|---|---|---|---|
| 1,188,146 | A | * | 6/1916 | Bogley | 211/74 |
| 2,314,935 | A | * | 3/1943 | Gutterman | 206/563 |
| 3,107,204 | A | * | 10/1963 | Brown et al. | 435/33 |
| 3,643,812 | A | * | 2/1972 | Mander et al. | 211/74 |
| 4,124,122 | A | * | 11/1978 | Emmitt | 211/74 |
| 5,378,433 | A | | 1/1995 | Duckett et al. | |
| 5,950,832 | A | * | 9/1999 | Perlman | 206/446 |
| 5,996,818 | A | * | 12/1999 | Boje et al. | 211/74 |
| 6,156,275 | A | * | 12/2000 | Dumitrescu et al. | 422/562 |

(Continued)

FOREIGN PATENT DOCUMENTS

| | | |
|---|---|---|
| DE | 10230519 | 1/2004 |
| EP | 0136126 | 4/1985 |
| FR | 2693369 | 1/1994 |
| WO | 2009015862 | 2/2009 |

OTHER PUBLICATIONS

PCT/EP2010/056522 International Search Report dated Aug. 19, 2010 (2 pages).

*Primary Examiner* — Robert J Hicks
(74) *Attorney, Agent, or Firm* — Michael Best & Friedrich

(57) ABSTRACT

The invention relates to a receptacle (10) for pharmaceutical containers, wherein a plurality of containers are arranged in rows next to one another and behind one another, and each container is arranged in a tube-like receiver (15). According to the invention, the container is cylindrically shaped, and a stop element (16) is integrated in each receiver (15), said element limiting the axial movement of the container in the receiver (15).

13 Claims, 2 Drawing Sheets

(56) References Cited

U.S. PATENT DOCUMENTS

| | | | | |
|---|---|---|---|---|
| 7,132,082 | B2 * | 11/2006 | Aviles et al. | 422/562 |
| 7,282,182 | B2 | 10/2007 | Dale et al. | |
| 2002/0108917 | A1 | 8/2002 | Maruyama | |
| 2003/0017084 | A1 * | 1/2003 | Dale et al. | 422/104 |
| 2005/0214924 | A1 | 9/2005 | Glaser et al. | |
| 2006/0266719 | A1 * | 11/2006 | Knight et al. | 211/74 |
| 2008/0134714 | A1 * | 6/2008 | Villanueva | 62/457.1 |
| 2010/0200583 | A1 * | 8/2010 | Curtin et al. | 220/4.27 |

* cited by examiner

RECEPTACLE FOR PHARMACEUTICAL CONTAINERS

BACKGROUND OF THE INVENTION

The invention relates to a receptacle for pharmaceutical containers. It is known from the pharmaceutical industry to store pre-sterilized syringe bodies in plastic trays (tubs). In this method, the syringe bodies are washed by a glassware or plasticware manufacturer and put into plastic retainers (the nest). The nest is then inserted into the plastic tray, whereupon the plastic tray is sealed and then pre-sterilized. At the pharmacist's, the plastic trays are opened and the containers filled and sealed. In this case, the syringe bodies hang in the plastic retainers on the hand rest of the syringe bodies. For a pharmaceutically optimal processing operation, they can be lifted and in this way removed from the side by a gripping tool.

SUMMARY OF THE INVENTION

Proceeding from the prior art described, the object of the invention is to design a receptacle for pharmaceutical containers which is suitable for processing cylindrical containers, in particular vials and/or cylindrical ampules. Here, at least substantially the same processing operation as with the syringe bodies mentioned is to be made possible in a filling and sealing line. As a result, it is to be possible to be able to process, using one and the same filling and sealing line, the most diverse pharmaceutical containers with the least possible resetting work. The invention is based on the idea of limiting an axial movement of the cylindrical containers via a respective stop element in the receiver. This stop element is therefore necessary since the abovementioned cylindrical vials or cylindrical ampules have no retaining edge like the syringe bodies, via which the container is fixed in its axial position in the receiver.

It is especially advantageous in this case if each receptacle has at least one aperture for a lifting element of a manipulating device. As a result, the mechanical processing and in particular the lifting of the containers from the receivers of the receptacle are made possible.

In a possible configuration of the aperture, said aperture is designed as a through-opening in the axial direction of the receiver on the side facing a bottom of the container. In this configuration, it is conceivable to lift the containers from the receivers of the receptacle by means of punch-like lifting elements which are arranged in the longitudinal direction of the containers below the receptacle.

However, it is especially preferred if the at least one aperture is formed at the circumference of the receiver and extends in the longitudinal direction thereof. It is thereby possible to use a strip-like or comb-like lifting device, which can be designed in a relatively simple manner.

In a preferred configuration, the apertures are formed as longitudinal slots which start from an end region of the receiver. In particular, provision is made here for longitudinal slots to be formed in each receiver, said longitudinal slots being arranged offset from one another by 180 degrees, and for the longitudinal slots of all the receivers located next to one another in a row to be in alignment.

It is thereby possible for all the containers located in the receivers to be lifted simultaneously by means of a comb-like or rail-like lifting element.

In order to simplify the re-insertion of the containers into the receptacle after the filling and sealing, provision is made in an advantageous configuration of the invention for an insertion bevel for the containers to be formed on the top side of the receiver.

In order to make possible simple sealing of the receptacle and in order to provide a receptacle which is pharmaceutically simple to clean, provision is also made for the receivers to be arranged on a plate-like support wall which preferably terminates flush with the top side of the receivers.

In addition, it is advantageous to provide the support wall with at least one aperture for manipulating the receptacle. As a result, the receptacle can be positioned or conveyed very easily inside a pharmaceutical device by means of a transport element, the transport element engaging in the aperture of the receptacle. Simple manual handling is also possible.

In particular, provision is made for the receptacle to be designed as an injection molding, and therefore the receptacle can be produced relatively economically.

BRIEF DESCRIPTION OF THE DRAWINGS

Further advantages, features and details of the invention follow from the description below of preferred exemplary embodiments and with reference to the drawings, in which.

DETAILED DESCRIPTION

Figure 1:
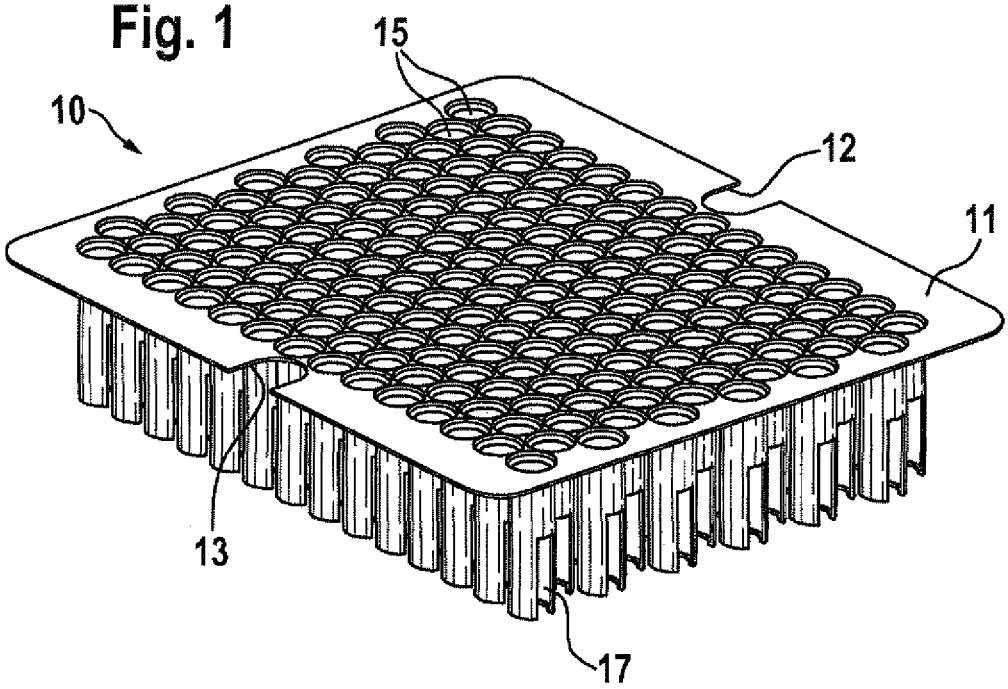
FIG. 1 shows a receptacle according to the invention for pharmaceutical containers, in a perspective view.
Figure 2:
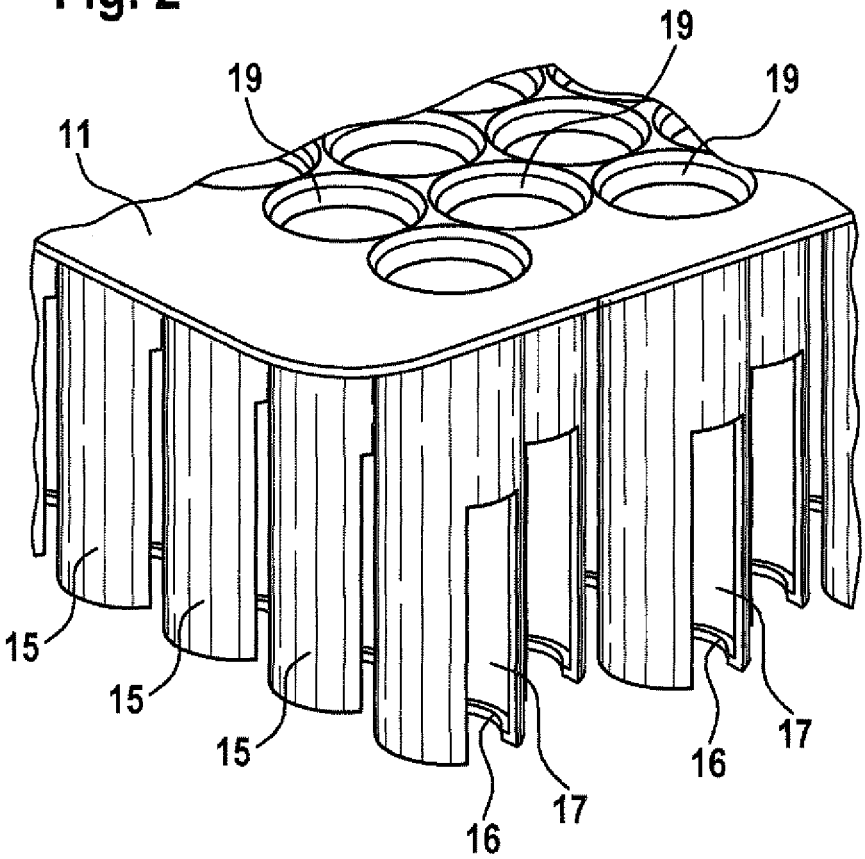
FIG. 2 shows a section of the receptacle according to FIG. 1, likewise in a perspective view.

The receptacle 10 shown in the figures serves to transport and store in particular cylindrical, pharmaceutical containers such as vials and/or cylindrical ampules. In this case, the containers are already washed by a glassware or plasticware manufacturer and put into the receptacle 10, whereupon the receptacle 10 is sealed by means of a plastic film (not shown in the figures) or else a covering element and passes in this state to the pharmacist for filling and sealing with a pharmaceutical.

The receptacle 10 has a substantially rectangular receiving plate 11 which has, by way of example, respective notches 12, 13 on its two opposite sides. By means of the notches 12, 13, the receptacle 10 can be exactly positioned within a filling and sealing line, for example relative to a manipulating device. The receptacle 10, designed in particular as an injection molding, has a multiplicity of in particular tube-like receivers 15 which are arranged next to one another and one behind the other and preferably at the same distances apart in the receptacle 10 and extend downward from the receiving plate 11.

On the underside of the receivers 15 opposite the receiving plate 11, said receivers 15 have, at their inner circumference, a drawn-in retaining edge 16 which serves as an axial stop element for the pharmaceutical containers in order to prevent the pharmaceutical containers in the receivers 15 from slipping through downward or out of the receivers 15. Furthermore, longitudinal slots 17, 18 arranged relative to one another by 180° extend in each of the receivers 15, in the exemplary embodiment from the underside of the receiver 15, said longitudinal slots 17, 18 being of substantially rectangular design and being in alignment with one another.

Figure 3:
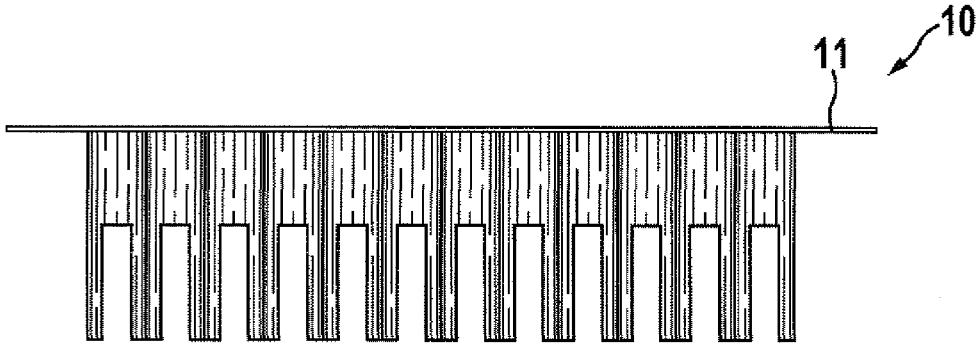
FIG. 3 shows a side view of the receptacle in FIGS. 1 and 2.
Figure 4:
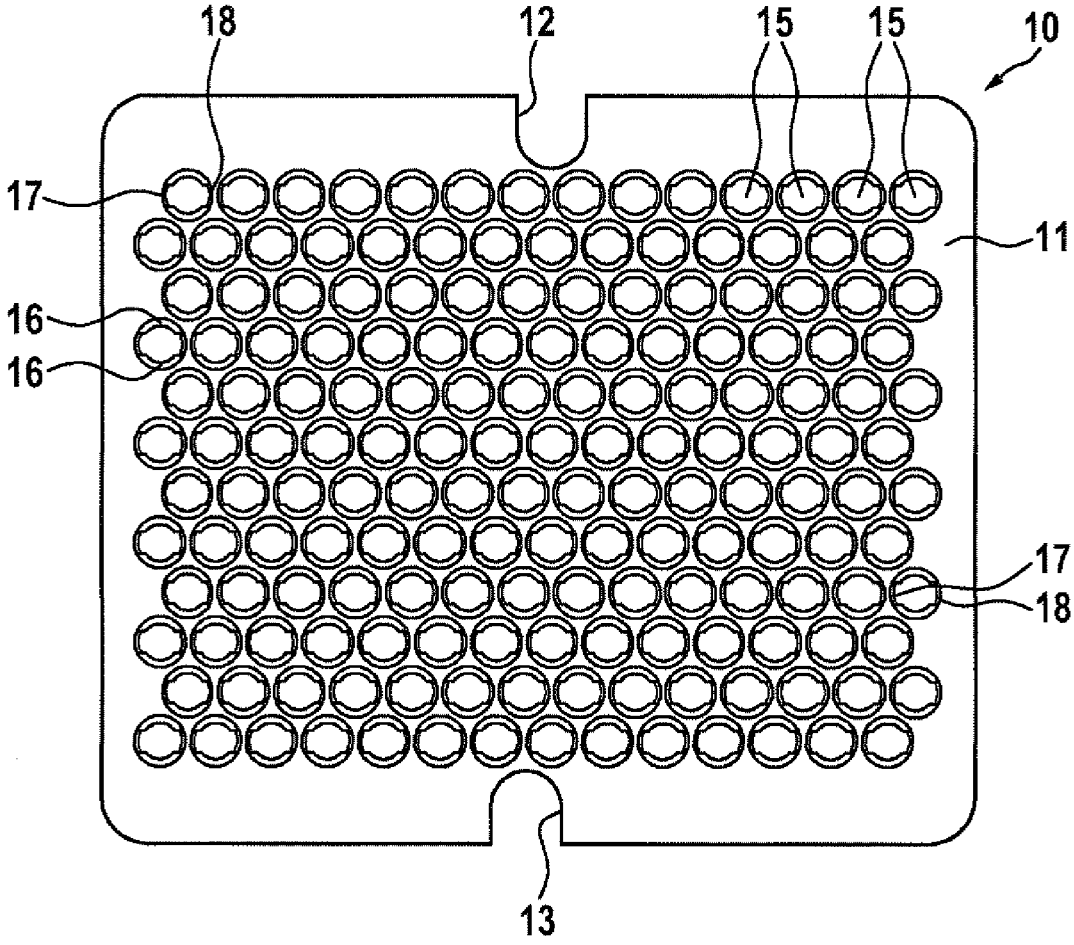
FIG. 4 shows a view from below of the receptacle shown in FIG. 1.

As can best be seen with reference to FIG. 3, it is thereby possible for a comb-like or rake-like lifting tool to be moved into the receivers 15 from the underside of the receptacle 10 and for said lifting tool to lift the containers located in the receivers 15 upward, such that said containers can be removed from the receptacle 10 in a simple manner by means of a manipulating robot or the like. The manipulating device or else an operator then takes the containers into a conveying device which conveys the containers to a filling and sealing station.

The containers, which are filled and sealed beforehand, must then be inserted into the corresponding receivers 15 of the receptacle 10 again. To this end, provision is made for additional insertion bevels 19 to be formed on the receiving plate 11 in the insertion region of the receivers 15. The insertion bevels 19 are of substantially frustoconical design and, if the containers are not positioned exactly above the receivers 15, enable the containers to be threaded or guided into the receivers 15 during the lowering of the containers into the receivers 15.

It may additionally be mentioned that the receptacle 10 described up to now can be modified in a variety of ways. It is thus conceivable, for example, to design a two-part receptacle which is split horizontally. The two parts can be connected to one another, for example, by a latching connection, wherein retainers or bearing surfaces for the containers are formed in the plate-like bottom part, whereas the top part is designed as a simple perforated plate.

The invention claimed is:

1. A receptacle (10) for pharmaceutical containers, in which a multiplicity of containers are arranged next to one another and one behind the other in rows, the containers each being arranged in receivers (15), characterized in that each of the containers is of cylindrical design and in that a respective discontinuous stop element (16) is assigned to each receiver (15), said stop element (16) limiting the axial movement of each container in each receiver (15), and characterized in that each receiver (15) has two longitudinal slots (17, 18) for a lifting element of a manipulating device, said longitudinal slots (17, 18) being arranged offset from one another by 180 degrees, and the longitudinal slots (17, 18) of all the receivers (15) located next to one another in a row are in alignment.

2. The receptacle as claimed in claim 1, characterized in that each of the slots is formed at a circumference of each receiver (15) and extends in a longitudinal direction thereof.

3. The receptacle as claimed in claim 1, characterized in that an insertion bevel (19) is formed on a top side of each of the receivers (15).

4. The receptacle as claimed in claim 1, characterized in that the receivers (15) are connected to a support wall (11).

5. The receptacle as claimed in claim 4, characterized in that the support wall (11) has at least one aperture (12, 13) for manipulating the receptacle (10).

6. The receptacle as claimed in claim 1, characterized in that the receptacle (10) is an injection molding.

7. The receptacle as claimed in claim 1, wherein the receivers (15) are tubular.

8. The receptacle as claimed in claim 1, characterized in that the receivers (15) are connected to a support wall (11) which terminates flush with a top side of the receivers (15).

9. The receptacle as claimed in claim 1, characterized in that the stop element (16) in each receiver (15) is a drawn-in retaining edge.

10. The receptacle as claimed in claim 1, characterized in that the stop element (16) in each receiver (15) is a circumferential ledge inside the receiver (15).

11. The receptacle as claimed in claim 1, characterized in that each of the receivers (15) includes no more than two of the longitudinal slots (17, 18).

12. The receptacle as claimed in claim 1, characterized in that the longitudinal slots (17, 18) extend approximately half an axial length of each of the receivers (15).

13. The receptacle as claimed in claim 1 wherein the longitudinal slots (17, 18) extend axially from an underside of the each receiver (15) and form a through-opening in an axial direction of each the receiver (15).

* * * * *